US008900408B2

(12) United States Patent
Yoshida et al.

(10) Patent No.: US 8,900,408 B2
(45) Date of Patent: Dec. 2, 2014

(54) PROCESS FOR PRODUCTION OF BLEACHED PULP

(75) Inventors: Kiyoshi Yoshida, Chiba (JP); Tetsuo Koshitsuka, Saitama (JP); Eiko Kuwabara, Chiba (JP); Takashi Ishii, Chiba (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 153 days.

(21) Appl. No.: 12/746,887

(22) PCT Filed: Dec. 5, 2008

(86) PCT No.: PCT/JP2008/072133

§ 371 (c)(1),
(2), (4) Date: Jul. 23, 2010

(87) PCT Pub. No.: WO2009/081714

PCT Pub. Date: Jul. 2, 2009

(65) Prior Publication Data

US 2010/0314056 A1 Dec. 16, 2010

(30) Foreign Application Priority Data

Dec. 20, 2007 (JP) ..... 2007-328493

(51) Int. Cl.

| | |
|---|---|
| ***D21C 9/14*** | (2006.01) |
| ***D21C 9/16*** | (2006.01) |
| *D21C 9/153* | (2006.01) |
| *D21C 9/10* | (2006.01) |
| *D21C 9/147* | (2006.01) |

(52) U.S. Cl.

CPC ..... *D21C 9/142* (2013.01); *D21C 9/153* (2013.01); *D21C 9/163* (2013.01); *D21C 9/1036* (2013.01); *D21C 9/147* (2013.01)

USPC ..... 162/82; 162/78; 162/87

(58) Field of Classification Search

USPC ..... 162/78, 67, 82, 87

See application file for complete search history.

(56) References Cited

U.S. PATENT DOCUMENTS

| | | | | |
|---|---|---|---|---|
| 5,091,054 | A | 2/1992 | Meier et al. | |
| 5,411,635 | A | 5/1995 | Francis et al. | |
| 5,439,663 | A * | 8/1995 | Manganaro et al. | 423/521 |
| 5,645,686 | A | 7/1997 | Troughton et al. | |
| 5,645,687 | A * | 7/1997 | Ambady et al. | 162/65 |
| 5,698,075 | A | 12/1997 | Troughton et al. | |
| 6,221,209 | B1 | 4/2001 | Desprez et al. | |
| 2003/0178164 | A1 * | 9/2003 | Ragnar | 162/49 |
| 2004/0112555 | A1 | 6/2004 | Tolan et al. | |
| 2009/0032207 | A1 * | 2/2009 | Laurila-Lumme et al. | 162/55 |
| 2009/0183845 | A1 | 7/2009 | Tomoda et al. | |

FOREIGN PATENT DOCUMENTS

| | | | | |
|---|---|---|---|---|
| CA | 2652325 | A1 * | 11/2007 | |
| GB | 815247 | A * | 6/1959 | D21C 9/14 |
| JP | 8-507332 | | 8/1996 | |
| JP | 10-500178 | | 1/1998 | |
| JP | 2001-527168 | | 12/2001 | |
| JP | 2003-247185 | | 9/2003 | |
| JP | 2004-169194 | | 6/2004 | |
| JP | 2007-169831 | | 7/2007 | |
| JP | 2007-308815 | | 11/2007 | |
| JP | 2007-308824 | | 11/2007 | |
| WO | 94/18386 | | 8/1994 | |
| WO | WO 0008251 | A1 * | 2/2000 | D21C 9/153 |
| WO | WO 2007113381 | A1 * | 10/2007 | |

OTHER PUBLICATIONS

NACASI, Environmental Footprint Comparison Tool, 2009, whole document.*

Danielsson et al. Kinetic Study of Hexenuronic and Methylglucuronic Acid Reactions in Pulp and in Dissolved Xylan during Kraft Pulping of Hardwood,2006, Ind. Eng. Chem. Res, 45, p. 2174-2178.NA.*

Allison et al., Hexenuronic acid in kraft pulps from radiate pine, 1999, APPITA Journal, 52(6), p. 448-453.*

Jiang et al., Hexenuronic acid groups in pulping and bleaching chemistry,2000,Tappi Journal, vol. 83 No. 1, p. 167-175.*

Smook, Handbook for Pulp and Paper Technologists, 1992, Angus Wilde Publications, 2nd edition, chapter 11.*

Search report from E.P.O., mail date is Aug. 6, 2012.

* cited by examiner

*Primary Examiner* — Anthony Calandra

(74) *Attorney, Agent, or Firm* — Greenblum & Bernstein, P.L.C.

(57) ABSTRACT

Provided is a process for producing bleached pulp, including subjecting unbleached pulp, which is obtained by cooking a lignocellulose substance, to alkali-oxygen bleaching treatment and then subjecting the alkali-oxygen bleached pulp to chlorine-free bleaching treatment including chlorine dioxide treatment, wherein in at least one chlorine dioxide treatment stage in which the chlorine dioxide treatment is performed, monopersulfuric acid is used in combination. The amount of chlorine dioxide to be used is reduced and the color reversion resistance of the bleached pulp is improved by this process.

7 Claims, No Drawings

PROCESS FOR PRODUCTION OF BLEACHED PULP

TECHNICAL FIELD

The present invention relates to a process for producing bleached pulp from a lignocellulose substance. More specifically, it relates to a process for producing ECF (elementary chlorine-free) bleached pulp, in which the colour reversion resistance of the bleached pulp is good and the amount of chlorine dioxide to be used is small.

BACKGROUND ART

Bleaching of chemical pulp for papermaking is attained in multistage bleaching treatment. Heretofore, in the multistage bleaching, a chlorine-base bleaching chemical is used as the bleaching agent. Concretely, bleaching is attained by a combination of chlorine, hypochlorite and chlorine dioxide, for example, in a sequence of C-E-H-D or C/D-E-H-E-D.

In the above, "C" means a chlorine treatment stage; "H" means a hypochlorite treatment stage; "D" means a chlorine dioxide treatment stage; "E" means an alkali treatment stage. "-" means that, after the step of the treatment stage described just before "-", the system is washed, and then, the step of the treatment stage described just after "-" is carried out. "/" means the treatment stage where the chemicals described just before and just after "/" are used in combination; and for example, "C/D" means a treatment stage where chlorine and chlorine dioxide are used in combination.

However, in bleaching, these chlorine-base bleaching chemicals release, as side products, organic chlorine compounds that are harmful to the environment, and the environmental pollution with the bleaching waste that contains those organic chlorine compounds is considered problematic. Organic chlorine compounds are analyzed and assessed generally by an AOX method, for example, by the US Environment Agency (EPA: METHOD-9020).

For reducing and preventing release of organic chlorine compounds as side products, it is most effective to reduce the amount of chlorine-base chemicals to be used or not to use them; and in particular, it is the most effective process not to use molecular chlorine in the initial stage. Pulp produced according to the process is referred to as ECF (elementary chlorine-free) pulp; and pulp produced according to a process using no chlorine-base chemical at all is referred to as TCF (totally chlorine-free) pulp.

As a process for bleaching cooked and oxygen-delignated pulp by no use of molecular chlorine in the initial stage, generally known is bleaching by use of a chlorine dioxide treatment stage as the initial stage according to a sequence of D-Eo-D, D-Eop-D, D-Eo-D-D, D-Eop-D-D, D-Eo-P-D or D-Eop-P-D, or bleaching by use of an ozone treatment stage as the initial stage according to a sequence of Z-Eop-D, Z-Eo-P-D or ZD-Eop-D.

In the above, "Z" means an ozone treatment stage; "P" means a hydrogen peroxide treatment stage. "p" means hydrogen peroxide; "o" means oxygen. "Eo" means an alkali treatment stage combined with oxygen; "Eop" means an alkali treatment stage combined with oxygen and hydrogen peroxide. "ZD" means continuous treatment of an ozone treatment stage (Z) and a chlorine dioxide treatment stage (D) with no washing between the two stages. The others are the same as mentioned above.

However, chlorine dioxide and ozone are inferior to conventionally used chlorine in point of the ability to remove hexeneuronic acid (which may be referred to as "HexA"), and therefore a large amount of HexA remains in the bleached pulp. The remaining HexA is a cause of the deterioration of the colour reversion resistance of ECF- or TCF-bleached pulp.

Hexeneuronic acid (HexA) is a substance resulting from demethanolation in a cooking step of α-glucuronic acid bonding to xylan, which is a hemicellulose existing in pulp. Though HexA has a small influence on the whiteness of pulp, it reacts with potassium permanganate, because of having a double bond in the molecule, and is counted as a K value or a kappa value; and this consumes a bleaching agent such as chlorine dioxide, ozone, etc.

As a papermaking process, there are known an acid papermaking process of using aluminium sulfate, and a neutral papermaking process of using calcium carbonate. Neutral paper worsens in colour reversion resistance with the increase in the HexA content thereof, but the degree of worsening is low; and it is the acid paper made by use of aluminium sulfate that particularly worsens in colour reversion resistance. The reason why the acid paper made according to an acid papermaking process worsens in colour reversion resistance is unknown at present, but the existence of HexA and the use of aluminium sulfate may be the reason for it.

In a paper mill, in general, neutral paper and acid paper are made separately from chlorine-free bleached pulp forwarded from a series of bleaching equipment, by use of a large number of papermaking machines. Accordingly, using the same chlorine-free bleached pulp forwarded from the same bleaching step, acid paper is made in one line and neutral paper is made in another line. In this case, even though the neutral paper made in the neutral papermaking line has no problem of the colour reversion resistance, the acid paper made in the acid papermaking line may have a problem of the colour reversion resistance.

As a method for improving this worsening of the colour reversion resistance, there is a method of removing HexA by increasing the amount to be used of chlorine dioxide or ozone having the ability to remove HexA. In this case, however, the pulp for neutral paper not requiring measures against the colour reversion must also be bleached, and it causes problems of too much increase in whiteness of the neutral paper and great increase in the cost for bleaching.

For solving the problems, proposed is a process of applying monopersulfuric acid (which may be referred to as "MPS") to bleaching, as mentioned below.

In place of chlorine bleaching treatment or delignination treatment by a combination of chlorine and chlorine dioxide, proposed is a TCF bleaching process of bleaching unbleached pulp by monopersulfuric acid treatment followed by alkaline hydrogen peroxide treatment (see Patent Reference 1). This process relates to initial stage delignination in the bleaching step; however, the reference describes nothing relating to the process of the present invention of treatment with monopersulfuric acid used in combination in the chlorine dioxide treatment stage, and to HexA removal, improvement of colour reversion resistance and viscosity reduction inhibitory effect.

In place of chlorine bleaching treatment or delignination treatment by a combination of chlorine and chlorine dioxide, proposed is a process of bleaching unbleached pulp by treatment with a combination of enzyme and monopersulfuric acid (see Patent Reference 2). This process relates to initial stage delignination in the bleaching step; however, the reference describes nothing relating to the process of the present invention of treatment with monopersulfuric acid used in combination in the chlorine dioxide treatment stage, and to HexA removal, improvement of colour reversion resistance and viscosity reduction inhibitory effect.

In place of chlorine bleaching treatment or delignination treatment by a combination of chlorine and chlorine dioxide, proposed is a process of bleaching unbleached pulp by treatment with a chelating agent, treatment with an alkaline hydrogen peroxide and treatment with monopersulfuric acid after oxygen bleaching (see Patent Reference 3). This process relates to initial stage delignination in the bleaching step; however, the reference describes nothing relating to the process of the present invention of treatment with monopersulfuric acid used in combination in the chlorine dioxide treatment stage, and to HexA removal, improvement of colour reversion resistance and viscosity reduction inhibitory effect.

In place of chlorine bleaching treatment or delignination treatment by a combination of chlorine and chlorine dioxide, proposed is a process of bleaching unbleached pulp by treatment with a combination of monopersulfuric acid and ozone (see Patent Reference 4). This process relates to initial stage delignination in the bleaching step; however, the reference describes nothing relating to the process of the present invention of treatment with monopersulfuric acid used in combination in the chlorine dioxide treatment stage, and to HexA removal, improvement of colour reversion resistance and viscosity reduction inhibitory effect.

For delignination process, proposed is a process of bleaching unbleached pulp by monopersulfuric acid treatment followed by alkaline hydrogen peroxide treatment after chelating agent treatment (see Patent Reference 5). This process relates to initial stage delignination in the bleaching step; however, the reference describes nothing relating to the process of the present invention of treatment with monopersulfuric acid used in combination in the chlorine dioxide treatment stage, and to HexA removal, improvement of colour reversion resistance and viscosity reduction inhibitory effect.

As a process of bleaching unbleached pulp, proposed is a process of treatment with a peracid and an alkaline earth metal in the final stage of bleaching (see Patent Reference 6). Monopersulfuric acid for use in the present invention is also a peracid; however, the process proposed in the reference differs at all from the process of the present invention in that, in the present invention, treatment with monopersulfuric acid used in combination in the chlorine dioxide treatment stage is performed and an alkaline earth metal is not used along with monopersulfuric acid. Further, in Patent Reference 6, peracetic acid is used as the peracid; however, the main object of the process is for increasing the whiteness, and the reference describes nothing relating to HexA removal, improvement of colour reversion resistance and viscosity reduction inhibitory effect.

As a process of post treatment after bleaching, proposed is a process of adding a bleaching agent between the bleaching step and a preparation step (see Patent Reference 7). Patent Reference 7 describes, as the bleaching agent, ozone, hydrogen peroxide, peracetic acid, percarbonic acid, perboric acid, and thiourea dioxide; however, the main object of this process is for increasing the whiteness, and the reference has no description relating to HexA removal and improvement of colour reversion resistance.

As a process of post treatment after bleaching, the present inventors have proposed a process including monopersulfuric acid treatment between the bleaching step and the preparation step (see Patent Reference 8). In this process, the finished pulp is treated with monopersulfuric acid to remove HexA from it and to improve the colour reversion resistance thereof; however, this suggests nothing relating to the process of the present invention that uses monopersulfuric acid in the chlorine dioxide treatment stage and to the effect of inhibiting the pulp viscosity reduction.

As a process of using monopersulfuric acid treatment in the initial stage of bleaching, the present inventors have proposed a process including treatment with an inorganic peroxide followed by multistage bleaching treatment starting from treatment with chlorine dioxide (see Patent Reference 9). In this process, monopersulfuric acid treatment is introduced into the initial stage of bleaching for removal of HexA and for improvement of colour reversion resistance. However, this process has some problems in that the pulp viscosity reduction is great owing to introduction of the monopersulfuric acid treatment thereinto and that the process is hardly usable in a papermaking process that requires high paper strength. Another problem is that the process requires an additional monopersulfuric acid treatment tower at the top of the conventional bleaching equipment for which the investment cost for the additional equipment is great.

Patent Reference 9 suggests nothing relating to the process of the present invention where monopersulfuric acid is used in combination in the chlorine dioxide treatment stage.

[Patent Reference 1] JP-T 6-505063
[Patent Reference 2] JP-A 7-150493
[Patent Reference 3] JP-T 8-507332
[Patent Reference 4] JP-T 8-511308
[Patent Reference 5] JP-T 10-500178
[Patent Reference 6] JP-T 2001-527168
[Patent Reference 7] JP-A 2004-169194
[Patent Reference 8] JP-A 2007-169831
[Patent Reference 9] WO 2007/132836

DISCLOSURE OF INVENTION

Problems that the Invention is to Solve

An object of the present invention is to improve the colour reversion resistance of chlorine-free bleached pulp with reducing the bleaching cost and keeping the pulp viscosity in the chlorine-free bleaching which does not use molecular chlorine in the initial stage in production of chemical pulp for papermaking. Further, the present invention is to provide a bleaching process more favorable for the environment, in which the amount of chlorine dioxide to be used is reduced and the formation of organic chlorine compound is retarded.

Means for Solving the Problems

The present inventions have made assiduous studies of chlorine-free bleaching treatment including chlorine dioxide treatment of cooked and alkali-oxygen bleached pulp, in which monopersulfuric acid is used in at least one chlorine dioxide treatment stage for the chlorine dioxide treatment (this may be referred to as "monopersulfuric acid-combined chloride dioxide treatment"), and, as a result, have found that even though pretreatment for metal ion removal such as chelating treatment is not performed, the pulp viscosity reduction owing to monopersulfuric acid may be inhibited and HexA can be removed with reducing the amount of chlorine dioxide to be used. The present inventors have further found that the combined use of monopersulfuric acid in the chlorine dioxide treatment stage reduces the amount of chlorine dioxide to be used, and the remaining amount of HexA after bleaching of pulp can be controlled to fall within a range not causing any problem, and the amount of the organic chlorine compound to be discharged can be reduced, and have completed the present invention.

Specifically the present application includes the following inventions:

(1) A process for producing bleached pulp, comprising:

subjecting unbleached pulp, which is obtained by cooking a lignocellulose substance, to alkali-oxygen bleaching treatment; and then subjecting the alkali-oxygen bleached pulp to chlorine-free bleaching treatment including chlorine dioxide treatment, wherein in at least one chlorine dioxide treatment stage in which the chlorine dioxide treatment is performed, monopersulfuric acid is used in combination.

(2) The process for producing bleached pulp of (1), wherein the chlorine dioxide treatment stage in which the monopersulfuric acid is used in combination is an initial stage after the alkali-oxygen bleaching treatment.

(3) The process for producing bleached pulp of (1), wherein the chlorine dioxide treatment stage in which the monopersulfuric acid is used in combination is a stage after a hydrogen peroxide treatment stage.

(4) The process for producing bleached pulp of (1), wherein the chlorine dioxide treatment stage in which the monopersulfuric acid is used in combination is a final stage of the chlorine-free bleaching treatment.

(5) The process for producing bleached pulp of (1) or (2), wherein the chlorine-free bleaching treatment includes:

the treatment in which the monopersulfuric acid is used in combination in the chlorine dioxide treatment stage, then alkali treatment in which oxygen and/or hydrogen peroxide are/is used in combination, and then chlorine dioxide treatment.

(6) The process for producing bleached pulp of (1) or (4), wherein the chlorine-free bleaching treatment includes:

chlorine dioxide treatment, then alkali treatment in which oxygen and/or hydrogen peroxide are/is used in combination, and then the treatment in which the monopersulfuric acid is used in combination in the chlorine dioxide treatment stage.

(7) The process for producing bleached pulp of (1), wherein the chlorine-free bleaching treatment includes:

ozone bleaching treatment, then with no washing, the treatment in which the monopersulfuric acid is used in combination in the chlorine dioxide treatment stage, then alkali treatment in which oxygen and/or hydrogen peroxide are/is used in combination, and then chlorine dioxide treatment.

(8) The process for producing bleached pulp of any one of (1) to (7), wherein as a sequence of adding the monopersulfuric acid in the chlorine dioxide treatment stage in which the monopersulfuric acid is used in combination, the monopersulfuric acid is added after chlorine dioxide has been added, the monopersulfuric acid and an acid for pH control are added after chlorine dioxide has been added, or chlorine dioxide and the monopersulfuric acid are added after an acid for pH control has been added.

(9) The process for producing bleached pulp of any one of (1) to (7), wherein in the chlorine dioxide treatment stage in which the monopersulfuric acid is used in combination, an alkali is added after chlorine dioxide and the monopersulfuric acid have been added, or an alkali is added simultaneously with the monopersulfuric acid after chlorine dioxide has been added, for desired pH control.

(10) The process for producing bleached pulp of any one of (1) to (9), wherein, bleached pulp after the chlorine-free bleaching treatment has a whiteness of from 70 to 89% and has remaining hexeneuronic acid in an amount of 10 μmol/pulp gram or less.

(11) Paper produced, at a papermaking pH of 6 or less, by use of the bleached pulp produced according to the production process of any of above (1) to (10).

Advantage of the Invention

The first characteristic feature of the present invention is as follows: In case where conventional chlorine bleaching is converted into chlorine-free bleaching, a large amount of HexA that has a relation with the colour reversion resistance of paper has remained and, as a result, especially in acid paper made from hardwood pulp, there exists a problem in that the colour reversion resistance of paper worsens; however, according to the process of the present invention, HexA can be efficiently removed merely by using monopersulfuric acid in combination in the chlorine dioxide treatment stage of chlorine-free bleaching treatment, without increasing the amount of chlorine dioxide or ozone to be used therein.

The second characteristic feature of the present invention is as follows: In treatment in which monopersulfuric acid is used alone, the pulp viscosity reduction is great and this is often problematic for some types of paper; however, in the present invention, monopersulfuric acid is used in combination in the chlorine dioxide treatment stage for treatment and therefore the pulp viscosity reduction can be retarded.

The third characteristic feature of the present invention is that, in the chlorine-free bleaching treatment including chlorine dioxide treatment, the amount of chlorine dioxide to be used can be reduced by the monopersulfuric acid-combined chlorine dioxide treatment. As a result, the formation of an organic chlorine compound can be retarded, and the present invention provides a pulp bleaching process more favorable to the environment.

The fourth characteristic feature of the present invention is that, monopersulfuric acid on-site produced from sulfuric acid and hydrogen peroxide at a low cost is used, and this is substituted for expensive chlorine dioxide, and therefore the pulp bleaching cost may be reduced.

The fifth characteristic of the present invention is that, HexA can be removed efficiently by using monopersulfuric acid in combination in the chlorine dioxide treatment stage for chlorine-free bleaching treatment, and therefore the production process for bleaching pulp can be easily attained without any additional equipment investment.

As described in the above, as a measure for preventing the colour reversion resistance of chlorine-free bleached pulp from worsening, in the present invention, monopersulfuric acid produced from inexpensive sulfuric acid and inexpensive hydrogen peroxide at a low cost is used, and the colour reversion resistance of chemical pulp produced according to a chlorine-free bleaching process can be improved at a reduced bleaching cost while the pulp is kept having excellent properties. In addition, the amount of chlorine dioxide to be used can be reduced, and therefore, the present invention provides a production process for bleached pulp favorable for the environment.

BEST MODE FOR CARRYING OUT THE INVENTION

The lignocellulose substance for use in the present invention is not specifically defined. For it, preferred is hardwood containing a large amount of methylglucuronic acid that forms hexeneuronic acid; but also usable are softwood and non-wood such as bamboo and hemp, and their mixtures. The cooking method to give pulp for use in the present invention may be any known cooking method such as kraft cooking, polysulfide cooking, soda cooking, and alkali sulfite cooking. In consideration of the pulp quality, the energy efficiency and the like, preferred is kraft cooking or polysulfide cooking.

For example, in case where lignocellulose of 100% hardwood is kraft-cooked, the sulfidity of the kraft-cooking liquid may be from 5 to 75% by mass, preferably from 15 to 45% by mass, the effective alkali addition rate may be from 5 to 30% by mass per bone dry wood mass, preferably from 10 to 25% by mass, and the cooking temperature may be from 130 to 170° C. The cooking method may be either a continuous cooking method or a batchwise cooking method. In case where a continuous cooking digestor is used, employable is a modified cooking method where a cooking liquid is added in plural points, and the cooking method is not specifically defined.

In cooking, a cooking promoter may be added to the cooking liquid used. The promoter includes known cyclic keto compounds, for example, benzoquinone, naphthoquinone, anthraquinone, anthrone, phenanthroquinone, and alkyl or amino-nucleus substituents of those quinone compounds, and hydroquinone compounds that are reduced products of those quinone compounds, such as anthrahydroquinone. In addition, one or more selected from stable compounds obtained as intermediates in anthraquinone production according to a Diels-Alder method, such as 9,10-diketohydroanthracene compounds may also be added. The addition rate of the cooling promoter may be any known one, for example, in a ratio of from 0.001 to 1.0% by mass per bone dry mass of wood chips.

The unbleached chemical pulp obtained in a known cooking method is delignated according to a known alkali-oxygen bleaching method, via washing, roughening and cleaning steps. A known middle-consistency method or high-consistency method may be directly applied to the alkali-oxygen bleaching method to be used in the present invention; but preferred is a middle-consistency method where the pulp consistency is from 8 to 15% by mass, which is now generally employed in the art.

In the alkali-oxygen bleaching method according to the above-mentioned middle-consistency method, sodium hydroxide or oxidized kraft white liquor can be used as the alkali, and oxygen from a low-temperature processing method, oxygen from PSA (pressure swing adsorption), oxygen from VSA (vacuum swing adsorption) or the like can be used as the oxygen gas.

The oxygen gas and the alkali are added to a middle-consistency pulp slurry in a middle-consistency mixer, fully mixed therein, and then the pulp, oxygen and alkali mixture is fed under pressure into a reactor tower in which the mixture is kept for a predetermined period of time, and delignated therein. The oxygen gas addition rate is generally from 0.5 to 3% by mass per bone dry (BD: bone dry) pulp mass, and the alkali addition rate is generally from 0.5 to 4% by mass. The reaction temperature is from 80 to 120° C., the reaction time is from 15 to 100 minutes, and the pulp consistency is from 8 to 15% by mass. The other conditions may be known ones. In the present invention, the above-mentioned alkali-oxygen bleaching is attained continuously plural times in the alkali-oxygen bleaching step, so as to promote the delignination as much as possible and to reduce the heavy metal content, and this is one preferred embodiment. The alkali-oxygen bleached pulp is then processed in a washing step. The washed pulp is transferred to a chlorine-free bleaching treatment step.

The chlorine-free bleaching sequence may include a chlorine dioxide-based ECF sequence of D-Ep-D, D-Eop-D, D-Ep-P-D, D-Eop-P-D, D-Ep-D-D, D-Eop-D-D, D-Ep-D-P or D-Eop-D-P; an ozone-based ECF sequence of Z-Ep-D, Z-Eop-D, Z-Ep-P-D, Z-Eop-P-D, Z-Ep-D-D, Z-Eop-D-D or Z-Ep-D-P; an ozone/chlorine dioxide-based ECF sequence of ZD-Ep-D, ZD-Eop-D, ZD-Ep-P-D, ZD-Eop-P-D, ZD-Ep-D-D, ZD-Eop-D-D, ZD-Ep-D-P or ZD-Eop-D-P. However, the type of the bleaching sequence does not whatsoever restrict the present invention at all.

The meanings of "D", "E", "Z", "P", "p", "o" and "-" are the same as above.

As the method of chlorine-free bleaching treatment of pulp after alkali-oxygen bleaching treatment to be applied to the present invention, there are mentioned various sequences as above. The chlorine-free bleaching treatment in the present invention includes chlorine dioxide treatment; and in at least one chlorine dioxide treatment stage in which the chlorine dioxide treatment is performed, monopersulfuric acid is used in combination.

As examples of the above-mentioned sequences, the bleaching process of D-Eop-D bleaching sequence in which monopersulfuric acid is used in combination in the initial chlorine dioxide treatment stage (initial stage D) or in the final chlorine dioxide treatment stage (final stage D), and the bleaching process of ZD-Eop-D bleaching sequence in which monopersulfuric acid is used in combination in the initial ozone and chlorine dioxide treatment stage (initial stage ZD) or in the final chlorine dioxide treatment stage (final stage D) are described.

The monopersulfuric acid for use in the present invention may be referred to as peroxymonosulfuric acid, and this may be produced through hydrolysis of peroxydisulfuric acid, or may be produced by mixing hydrogen peroxide and sulfuric acid in an arbitrary ratio; and its production process is not specifically defined. A double monopersulfate ($2\ KHSO_5.KHSO_4.K_2SO_4$), oxone may also be used here. In consideration of the economical aspect thereof, a preferred embodiment is use of monopersulfuric acid produced at low cost by mixing an inexpensive high-concentration hydrogen peroxide and an inexpensive high-concentration sulfuric acid.

In a method of producing monopersulfuric acid by mixing a high-concentration hydrogen peroxide and a high-concentration sulfuric acid, preferred is a method of dropwise adding concentrated sulfuric acid having a concentration of from 80 to 98% by mass, preferably from 93 to 98% by mass, to aqueous hydrogen peroxide having a concentration of from 20 to 70% by mass, preferably from 35 to 70% by mass, and mixing them. The mixing ratio by mol of sulfuric acid to hydrogen peroxide is preferably from 1/1 to 5/1, more preferably from 2/1 to 4/1. When hydrogen peroxide and sulfuric acid having a low concentration are used, then it is unfavorable since the production efficiency of monopersulfuric acid lowers. However, when the concentration of these is too high, such is also unfavorable as the risk such as firing may increase. In addition, when the mixing molar ratio of sulfuric acid and hydrogen peroxide oversteps the range of from 1/1 to 5/1, it is also unfavorable since the production efficiency of monopersulfuric acid lowers.

As the treatment conditions for the ordinary initial chlorine dioxide treatment stage, the chlorine dioxide addition rate is preferably from 0.2 to 2.0% by mass per bone dry pulp mass. The treatment pH is preferably from 1.5 to 6, more preferably from 2 to 4. A known alkali or acid may be used for pH control. The treatment time is preferably from 1 minute to 5 hours, more preferably from 10 to 180 minutes. The treatment temperature is preferably from 20 to 100° C., more preferably from 40 to 90° C. The pulp consistency in the pulp slurry is not specifically defined. In general, it is from 5 to 30% by mass, and from the viewpoint of operability, preferably from 8 to 15% by mass.

The monopersulfuric acid addition rate in the case of using monopersulfuric acid in combination in the initial chlorine dioxide treatment stage is preferably from 0.01 to 2% by mass per bone dry pulp mass, more preferably from 0.1 to 1% by mass.

The treatment conditions in the case of using monopersulfuric acid in combination in the initial chlorine dioxide treatment stage are respectively the same as those in the above-mentioned ordinary initial chlorine dioxide treatment stage; and particularly preferable ranges are respectively the treatment pH of from 2.5 to 3.5, the treatment time of from 30 to 120 minutes and the treatment temperature of from 60 to 80° C.

For performing the treatment in the above-mentioned particularly preferred pH range, the addition sequence of the chemicals is also important. Addition of monopersulfuric acid to alkaline pulp is unfavorable as promoting the decomposition. Accordingly, preferred is a process of adding chlorine dioxide to pulp and mixing them, and then adding monopersulfuric acid thereto and mixing them; a process of adding chlorine dioxide to pulp and mixing them, and then monopersulfuric acid and an acid for pH control are added thereto and mixing them; or a process of adding an acid for pH control to pulp and mixing them, and then chlorine dioxide and monopersulfuric acid are added thereto and mixing them.

When chlorine dioxide is added to pulp, then the mixture is no more alkaline in this condition; and therefore, when monopersulfuric acid is added thereto, monopersulfuric acid is not excessively decomposed. Accordingly, in case where monopersulfuric acid and an acid for pH control are added, the addition sequence for monopersulfuric acid and the acid for pH control is not specifically defined.

In case where an acid for pH control is added to pulp, the mixture is no more alkaline in this condition; and therefore, when monopersulfuric acid is added thereto, monopersulfuric acid is not excessively decomposed. Accordingly, in case where chlorine dioxide and monopersulfuric acid are added, the addition sequence for chlorine dioxide and monopersulfuric acid is not specifically defined.

In case where an alkali is added for pH control, it prevents promotion of the decomposition of monopersulfuric acid, and therefore, it is preferable that, after chlorine dioxide and monopersulfuric acid are added to pulp and then mixed, an alkali is added thereto, or after chlorine dioxide is added to pulp and then mixed, monopersulfuric acid and an alkali are added thereto at a time.

As the acid for pH control, usable are inorganic and organic acids, such as hydrochloric acid, sulfuric acid, nitric acid, formic acid, oxalic acid, etc. Preferred is sulfuric acid. As the alkali for pH control, usable are inorganic and organic alkalis such as sodium hydroxide, potassium hydroxide, sodium carbonate, calcium carbonate, ammonia, amines, etc. Preferred is sodium hydroxide.

Regarding the treatment conditions for the ozone treatment stage in the initial ozone and chlorine dioxide treatment stage, the ozone addition rate is preferably from 0.05 to 2% by mass per bone dry pulp mass, more preferably from 0.1 to 1% by mass. The treatment pH is preferably from 1 to 7, more preferably from 2 to 5, even more preferably from 2.5 to 4. A known alkali or acid may be used for pH control. The treatment time is from tens seconds to tens minutes. The treatment temperature is preferably from 20 to 100° C., more preferably from 40 to 80° C. The pulp consistency is not specifically defined. It may be a high consistency of 33% by mass or so, or may be a middle consistency of 10% by mass or so.

The ozone-treated pulp is transferred to a chlorine dioxide treatment stage without being washed. The chlorine dioxide treatment stage is performed under the same treatment conditions as in the above-mentioned ordinary initial chlorine dioxide treatment stage.

In case where monopersulfuric acid is used in combination in this initial chlorine dioxide treatment stage, the conditions for the above-mentioned initial chlorine dioxide treatment stage using monopersulfuric acid in combination are applicable thereto.

The pulp thus processed in the initial stage for the chlorine dioxide treatment, the treatment of using monopersulfuric acid in combination in the chlorine dioxide treatment stage, the ozone and chlorine dioxide treatment, or the treatment using monopersulfuric acid in combination in the chlorine dioxide treatment stage in the ozone and chlorine dioxide treatment, is transferred to a washing step. In the washing step, usable is any washing machine capable of efficiently washing the pulp to remove the remaining chemicals, COD and the like from it; and for example, usable is a diffusion-type, press-type or wire-type washing machine.

The washed pulp is transferred into an alkali treatment step in which oxygen and/or hydrogen peroxide are/is used in combination (this may be referred to as "alkali/oxygen/hydrogen peroxide treatment"). In general, the alkali amount is from 0.5 to 3.0% by mass; the oxygen amount is from 0.05 to 0.3% by mass; and the hydrogen peroxide amount is from 0.05 to 1.0% by mass. Regarding the treatment pH, the pH after bleaching is preferably from 10 to 12, more preferably from 11.0 to 11.7. The treatment time is preferably from 15 minutes to 5 hours, more preferably from 30 minutes to 3 hours.

The alkali/oxygen/hydrogen peroxide-treated pulp is transferred to a washing step. In the washing step, usable is any washing machine capable of washing the pulp to remove the remaining chemicals, COD and others from it.

The washed pulp is transferred to the final chlorine dioxide treatment stage. The chlorine dioxide addition rate in this treatment stage is preferably from 0.05 to 1.0% by mass per bone dry pulp mass, more preferably from 0.1 to 0.5% by mass. The treatment pH is preferably from 1.5 to 6, more preferably from 3 to 6, even more preferably from 4 to 6. A known alkali or acid may be used for pH control. The treatment time is preferably from 15 minutes to 5 hours, more preferably from 30 to 180 minutes. The treatment temperature is preferably from 20 to 100° C., more preferably from 50 to 80° C. The pulp consistency is not specifically defined. In general, it is from 5 to 30% by mass, but preferably from 8 to 15% by mass in view of the operability.

The addition rate of monopersulfuric acid in the case of using monopersulfuric acid in combination in the final chlorine dioxide treatment stage is preferably from 0.01 to 2% by mass per bone dry pulp mass, more preferably from 0.1 to 1% by mass. The treatment conditions in the case of using monopersulfuric acid in combination in the final chlorine dioxide treatment stage are respectively the same as those in the above-mentioned ordinary final chlorine dioxide treatment stage; and particularly preferable ranges are respectively the treatment pH of from 4.0 to 5.5, the treatment time of from 30 to 120 minutes and the treatment temperature of from 60 to 80° C.

For performing the treatment in the above-mentioned particularly preferred pH range, the addition sequence of the chemicals is also important. Addition of monopersulfuric acid to alkaline pulp is unfavorable as promoting the decomposition.

Accordingly, the addition sequence of the chemicals is preferably the same as that for performing the treatment in the particularly preferred pH range in the above-mentioned initial chlorine dioxide treatment stage in which monopersulfuric acid is used in combination.

Preferably, the whiteness of the pulp bleached in the above-mentioned chlorine-free bleaching sequence is from 70 to 89%. The K value and the remaining amount of HexA which are the index of the colour reversion degree of pulp are preferably as low as possible. For this, however, a large amount of a bleaching agent is needed, and this is problematic in point of the pulp viscosity reduction and the cost increase. Accordingly, as the pulp properties suitable to the process of the present invention capable of solving both the problems of pulp discoloration and bleaching cost increase, the K value is preferably 1.5 or less, and the remaining amount of HexA is preferably 10 μmol/pulp gram or less.

Pulp thus bleached in the above-mentioned chlorine-free bleaching sequence to have desired whiteness, K value and HexA remaining amount is fed to a papermaking step via a storage step, and is formed into paper (acid paper), for example, under a condition of a papermaking pH of 6 or less.

The monopersulfuric acid-combined chlorine dioxide treatment is characterized in that the pulp viscosity reduction is smaller than in treatment in which monopersulfuric acid is used alone. For further preventing the viscosity reduction, a chelating agent, a polycarboxylic acid or their mixture is preferably used in combination in the monopersulfuric acid-combined chlorine dioxide treatment.

The chelating agent usable in the present invention includes carboxylic acid-type ones such as ethylenediamine-tetraacetic acid (EDTA), diethylenetriamine-pentaacetic acid (DTPA), and nitrilotriacetic acid (NTA); and phosphonic acid-type ones such as 1-hydroxylethylidene-1,1-diphosphonic acid (HEDPA), ethylenediamine-tetra(methylenephosphonic) acid (EDTMPA), diethylenetriamine-penta(methylenephosphonic) acid (DTPMPA), and nitrotri (methylenephosphonic) acid (NTMPA).

The amount of the chelating agent to be used is preferably within a range of from 0.02 to 0.3% (as % by mass relative to pulp). When added more than the range, it brings about a problem that the HexA removing capacity of monopersulfuric acid may lower; and when less than the range, the pulp viscosity reduction-inhibiting effect may be poor.

As the polycarboxylic acid, usable are oxalic acid, succinic acid, tartaric acid, maleic acid, fumaric acid, phthalic acid, citric acid, malonic acid, adipic acid, malic acid, etc.

The amount of the polycarboxylic acid is preferably within a range of from 0.02 to 0.3% (as % by mass relative to pulp). When added more than the range, it brings about a problem that the HexA removing capacity of monopersulfuric acid may lower; and when less than the range, the pulp viscosity reduction-inhibiting effect may be poor.

In case where a mixture of a chelating agent and a polycarboxylic acid is used, its amount is preferably within a range of from 0.02 to 0.3% (as % by mass relative to pulp). When added more than the range, it brings about a problem that the HexA removing capacity of monopersulfuric acid may lower; and when less than the range, the pulp viscosity reduction-inhibiting effect may be poor.

EXAMPLES

The present invention is described more concretely with reference to the following Examples and Comparative Examples; needless-to-say, however, the present invention should not be limited to these Examples. Unless otherwise specifically indicated, in the following Examples and Comparative Examples, the monopersulfuric acid production, the measurement of the potassium manganate value (K value) of pulp, the measurement of the whiteness thereof, the measurement of the viscosity thereof, and the evaluation of the discoloration resistance thereof were carried out according to the processes mentioned below. The addition rate of chemicals in Examples and Comparative Examples is % by mass per bone dry pulp mass.

1. Production of Monopersulfuric Acid:

1809.8 g of industrial-level 95% sulfuric acid was added to 441.8 g of industrial-level 45% by mass aqueous hydrogen peroxide to produce monopersulfuric acid. The composition of the produced aqueous monopersulfuric acid solution was 18.17% by mass of monopersulfuric acid, 3.35% by mass of hydrogen peroxide, 60.81% by mass of sulfuric acid, and 17.77% by mass of water.

2. Measurement of Potassium Permanganate Value (K Value) of Pulp:

The potassium permanganate value is measured according to TAPPI UM 253.

3. Measurement of Pulp Viscosity:

The pulp viscosity is measured according to J. TAPPI No. 44 method.

4. Measurement of Pulp Whiteness:

Bleached pulp is difibrated, then formed into two sheets each having a weight of 400 g/m$^2$ according to ISO 3688-1977, and the pulp whiteness is measured according to JIS P 8148.

5. Evaluation of Colour Reversion Resistance of Pulp (Computation of PC Value):

Bleached pulp is difibrated, then controlled to have a pH of 4.5 with aluminium sulfate added thereto, and then formed into two sheets each having a weight of 400 g/m$^2$, which are dried with an air drier. The sheets are discolored for 24 hours under conditions of 80° C. and a relative humidity 65%, and from the whiteness thereof before and after the colour reversion, the PC value is computed according to the following formula, thereby evaluating the colour reversion resistance of the pulp.

$$PC\ \text{value}=[\{(1-\text{whiteness after colour reversion})^2/(2\times\text{whiteness after colour reversion})\}-\{(1-\text{whiteness before colour reversion})^2/(2\times\text{whiteness before colour reversion})\}]\times 100.$$

6. Measurement of Hexeneuronic Acid (HexA) Amount of Pulp:

0.8 g, as its bone dry mass, of completely washed pulp is weighed accurately. The pulp is put into a pressure container, 80 ml of pure water is added thereto, and then this is controlled to have a pH of 3 with formic acid added thereto. The pressure container is put into an oven, processed at 120° C. for 4 hours therein for acid hydrolysis of HexA. After the treatment, this is filtered, and the acid hydrolyzates of HexA, 2-furan-carboxylic acid and 5-carboxy-2-furanaldehyde existing in the solution separated through the filtration are quantitatively determined through HPLC. From the total of their molar amounts, the original HexA amount is derived.

7. Physical Properties of Starting Unbleached Pulp:

The physical properties of the starting unbleached pulp used herein are shown below.

Starting unbleached pulp: Pulp after alkali-oxygen bleaching.

Whiteness of pulp: 51.2%, K value: 6.8, Viscosity: 18.6 mPa·s, HexA amount: 36.7 μmol/pulp gram.

8. Bleaching Conditions in Each Stage of Chlorine-Free Bleaching Treatment:

The bleaching conditions in each stage of the chlorine-free bleaching treatment are shown below.

A or initial MPS: pulp consistency 10%, temperature 60° C., period of time 60 minutes.

Z: pulp consistency 10%, temperature 60° C., period of time 3 minutes.

D0 or D0/MPS: pulp consistency 10%, temperature 60° C., period of time 60 minutes.

Eop: pulp consistency 10%, temperature 60° C., period of time 90 minutes.

D1 or D1/MPS: pulp consistency 10%, temperature 60° C., period of time 120 minutes.

Final MPS: pulp consistency 10%, temperature 60° C., period of time 120 minutes.

Washing condition in each stage (except stage Z): washing degree 90% (after bleaching, the pulp was diluted with hollow fiber-filtered water to have a pulp consistency of 2.5%, and then dewatered to have a pulp consistency of 20%).

"D0" means an initial chlorine dioxide treatment stage; "D1" means a final chlorine dioxide treatment stage; "A" means acid treatment. "Eop" means an alkali treatment stage with oxygen and hydrogen peroxide used in combination, as mentioned above, and this may be referred to as "alkali/oxygen/hydrogen peroxide treatment stage". The others are the same as above.

Example 1

D0/MPS Treatment 30 g of starting unbleached pulp after alkali-oxygen bleaching was sampled in a polyethylene bag. Hollow fiber-filtered water necessary for bleaching at a pulp consistency of 10% was added to it, and immersed in a constant temperature water tank at 60° C. for 45 minutes thereby to preheat the starting unbleached pulp. Sulfuric acid was added to it in an amount to make the pulp have a pH of 3 after the reaction, and well mixed, and then 0.5% by mass of chlorine dioxide and subsequently 0.3% by mass of monopersulfuric acid were added thereto, well mixed, and immersed in a constant temperature water tank for 60 minutes. This is monopersulfuric acid-combined chlorine dioxide treatment in the initial chlorine dioxide treatment stage. The treated pulp was washed under the above-mentioned washing condition. 16 g, as bone dry (BD) mass, of the washed pulp was sampled, diluted with pure water to be 2 L, then controlled to have a pH of 5.5 with aqueous sulfurous acid, and formed into two pulp sheets on a Buchner funnel (acid papermaking). After dried in air overnight, the whiteness, the K value, the HexA amount and the viscosity of the pulp were measured.

Example 2

D0/MPS Treatment

This is the same as in Example 1, in which, however, the amount of monopersulfuric acid added was changed from 0.3% by mass in Example 1 to 0.6% by mass.

Comparative Example 1

MPS-D0 Treatment 30 g of starting unbleached pulp after alkali-oxygen bleaching was sampled in a polyethylene bag. Hollow fiber-filtered water necessary for bleaching at a pulp consistency of 10% was added to it, and immersed in a constant temperature water tank at 60° C. for 45 minutes thereby to preheat the starting unbleached pulp. Sulfuric acid was added to it in an amount to make the pulp have a pH of 3 after the reaction, and well mixed, and then 0.3% by mass of monopersulfuric acid was added thereto, well mixed and immersed in a constant temperature water tank for 60 minutes. This is initial monopersulfuric acid treatment. The treated pulp was washed under the above-mentioned washing condition. Next, hollow fiber-filtered water necessary for bleaching at a pulp consistency of 10% was added to it, and immersed in a constant temperature water tank at 60° C. for 45 minutes thereby to preheat the pulp. Sulfuric acid in an amount to make the pulp have a pH of 3 after the reaction and 0.5% by mass of chlorine dioxide were added to the pulp in this order, them mixed, and immersed in a constant temperature water tank for 60 minutes. This is the initial chlorine dioxide treatment. The treated pulp was washed under the above-mentioned washing condition. Next, in the same manner as in Example 1, this was formed into two pulp sheets, and dried in air overnight, and the whiteness, the K value, the HexA amount and the viscosity of the pulp were measured.

Comparative Example 2

MPS-D0 treatment

This is the same as in Comparative Example 1, in which, however, the amount of monopersulfuric acid was changed from 0.3% by mass in Comparative Example 1 to 0.6% by mass.

The results of Examples 1 and 2 and Comparative Examples 1 and 2 are shown in Table 1.

The case of monopersulfuric acid treatment followed by chlorine dioxide treatment in Comparative Examples 1 and 2 is problematic in that the pulp viscosity after bleaching greatly lowers. As opposed to this, the treatment with monopersulfuric acid used in combination in the chlorine dioxide treatment stage in Examples 1 and 2 significantly retarded the pulp viscosity reduction.

TABLE 1

| | Whiteness (%) | K value | HexA (μmol/g) | Viscosity (mPa · s) |
|---|---|---|---|---|
| Example 1 | 70.1 | 3.4 | 22.0 | 18.5 |
| Example 2 | 71.3 | 2.5 | 17.3 | 16.9 |
| Comparative Example 1 | 70.0 | 3.7 | 22.6 | 14.4 |
| Comparative Example 2 | 71.2 | 2.7 | 18.1 | 13.7 |

Example 3

D0/MPS-Eop-D1

The pulp processed for monopersulfuric acid-combined chlorine dioxide treatment under the conditions in Example 1 was washed under the above-mentioned washing condition; and then 0.9% by mass of NaOH, 0.15% by mass of oxygen and 0.25% by mass of hydrogen peroxide were added to the pulp, and processed for alkali/oxygen/hydrogen peroxide treatment under the conditions mentioned above. The treated pulp was washed under the above-mentioned washing condition. 0.2% by mass of chlorine dioxide and a predetermined amount of sulfuric acid were added to the washed pulp and immersed in a constant temperature water tank for 2 hours. This is final chlorine dioxide treatment. Sulfuric acid added here was in an amount necessary to make the system have a pH of 5 after the reaction. The treated pulp was washed under the above-mentioned washing condition; and then, in the same manner as in Example 1, this was formed into two pulp sheets, and dried in air overnight, and the whiteness, the K value, the HexA amount, the viscosity and the PC value of the pulp were measured.

Comparative Example 3-1

D0-Eop-D1

In the same manner as in the initial chlorine dioxide treatment stage as in Example 1, pulp was treated with 0.55% by mass of chlorine dioxide but monopersulfuric acid was not added thereto, and the pulp was washed under the above-mentioned washing condition; and then this was processed for alkali/oxygen/hydrogen peroxide treatment and final chlorine dioxide treatment in the same manner as in Example 3. The treated pulp was washed under the above-mentioned washing condition; and then, in the same manner as in Example 1, this was formed into two pulp sheets, and dried in air overnight, and the whiteness, the K value, the HexA amount, the viscosity and the PC value of the pulp were measured.

Comparative Example 3-2

D0-Eop-D1

This is the same as in Comparative Example 3-1, in which, however, the chlorine dioxide addition rate in the initial chlorine dioxide treatment stage was changed from 0.55% by mass in Comparative Example 3-1 to 0.7% by mass.

Comparative Example 4

MPS-D0-Eop-D1

This is the same as in Example 3, in which, however, the pulp that had been bleached according to the initial chlorine dioxide treatment in Comparative Example 1 and then washed under the above-mentioned washing condition was used in place of the pulp treated under the conditions of Example 1 and used in Example 3.

The results of Example 3, and Comparative Examples 3-1, 3-2 and 4 are shown in Table 2.

In Example 3, monopersulfuric acid was used in combination in the initial chlorine dioxide treatment stage, and therefore, the whiteness, the K value, the HexA amount and the PC value of the bleached pulp were all on a level with no problem, and the pulp viscosity reduction was small. As opposed to this, the case of chlorine dioxide-based chlorine-free bleaching not using monopersulfuric acid is problematic in that the K value and the remaining HexA amount of the bleached pulp are high as in Comparative Example 3-1 in which the chlorine dioxide addition rate is to give the pulp whiteness on the same level as in Example 3, and therefore the colour reversion resistance of the pulp is poor (the PC value of the pulp is high). In order that the pulp is made to have the colour reversion resistance on the same level as in Example 3, like in Comparative Example 3-2, the chlorine dioxide addition rate must be greatly increased and the whiteness after bleaching becomes too high over the necessary level. In the two-stage treatment of monopersulfuric acid treatment followed by chlorine dioxide treatment in Comparative Example 4, the K value and the remaining HexA amount of the pulp are low and the colour reversion resistance of the pulp has no problem; however, in this, the viscosity reduction is great, and is therefore problematic in that this could not be used in making paper that requires paper strength. In Example 3, monopersulfuric acid is used in combination in the chlorine dioxide treatment stage, and therefore the process does not require any additional bleaching tower as in Comparative Example 4, and its significant advantage is that an existing chlorine dioxide tower can be used in the process.

TABLE 2

| | Whiteness (%) | K value | HexA (μmol/g) | Viscosity (mPa · s) | PC Value |
|---|---|---|---|---|---|
| Example 3 | 87.4 | 1.2 | 7.5 | 17.2 | 2.8 |
| Comparative Example 3-1 | 87.3 | 1.8 | 14.1 | 17.4 | 5.2 |
| Comparative Example 3-2 | 89.3 | 1.2 | 7.5 | 17.1 | 2.8 |
| Comparative Example 4 | 87.5 | 1.2 | 7.4 | 11.1 | 2.9 |

Example 4

D0-Eop-D1/MPS)

30 g of starting unbleached pulp after alkali-oxygen bleaching was sampled in a polyethylene bag. Hollow fiber-filtered water necessary for bleaching at a pulp consistency of 10% was added to it, and immersed in a constant temperature water tank at 60° C. for 45 minutes thereby to preheat the starting unbleached pulp. Sulfuric acid in an amount to make the pulp have a pH of 3 after the reaction and 0.5% by mass of chlorine dioxide were added to the pulp in this order, then mixed, and immersed in a constant temperature water tank for 60 minutes. This is the initial chlorine dioxide treatment. The treated pulp was washed under the above-mentioned washing condition. Next, 0.9% by mass of NaOH, 0.15% by mass of oxygen and 0.25% by mass of hydrogen peroxide were added to the pulp, and processed for alkali/oxygen/hydrogen peroxide treatment under the above-mentioned predetermined conditions. The treated pulp was washed under the above-mentioned washing condition. 0.2% by mass of chlorine dioxide, and 0.3% by mass of monopersulfuric acid were added to the washed pulp in this order, well mixed, and a predetermined amount of a sodium hydroxide solution was added to the pulp, mixed, and immersed in a constant temperature water tank for 2 hours. This is monopersulfuric acid-combined chlorine dioxide treatment in the final chlorine dioxide treatment stage. Sodium hydroxide added here was in an amount necessary to make the system have a pH of 5 after the reaction. The treated pulp was washed under the above-mentioned washing condition, and then formed into two pulp sheets in the same manner as in Example 1, and dried in air overnight; and the whiteness, the K value, the HexA amount, the viscosity and the PC value of the pulp were measured.

Comparative Example 5

D0-Eop-D1-MPS 30 g of starting unbleached pulp after alkali-oxygen bleaching was sampled in a polyethylene bag. Hollow fiber-filtered water necessary for bleaching at a pulp consistency of 10% was added to it, and immersed in a constant temperature water tank at 60° C. for 45 minutes thereby to preheat the starting unbleached pulp. Sulfuric acid in an amount to make the pulp have a pH of 3 after the reaction and 0.5% by mass of chlorine dioxide were added to the pulp in this order, then mixed, and immersed in a constant temperature water tank for 60 minutes. This is the initial chlorine dioxide treatment. The treated pulp was washed under the above-mentioned washing condition. Next, 0.9% by mass of NaOH, 0.15% by mass of oxygen and 0.25% by mass of hydrogen peroxide were added to the pulp, and processed for alkali/oxygen/hydrogen peroxide treatment under the above-mentioned predetermined conditions. The treated pulp was washed under the above-mentioned washing condition. Sulfuric acid and 0.2% by mass of chlorine dioxide were added to the washed pulp in this order, mixed, and immersed in a constant temperature water tank for 2 hours. This is the final chlorine dioxide treatment. The sulfuric acid added here was in an amount necessary to make the system have a pH of 5 after the reaction. The treated pulp was washed under the above-mentioned washing condition, and then sulfuric acid and 0.3% by mass of monopersulfuric acid were added to the pulp in this order, and dipped in a constant temperature water tank at 60° C. for 120 minutes. This is the final-stage monopersulfuric acid treatment. Sulfuric acid added here was in an amount necessary to make the system have a pH of 5 after the reaction. The treated pulp was washed under the above-mentioned washing condition, and then formed into two pulp sheets in the same manner as in Example 1, and dried in air overnight; and the whiteness, the K value, the HexA amount, the viscosity and the PC value of the pulp were measured.

The results of Example 4, Comparative Examples 3-1, 3-2 and Comparative Example 5 are shown in Table 3.

In Example 4, monopersulfuric acid was used in combination in the final chlorine dioxide treatment stage, and therefore, the whiteness, the K value, the HexA amount and the PC value of the bleached pulp were all on a level with no problem, and the pulp viscosity reduction was small. As opposed to this, the case of chlorine dioxide-based chlorine-free bleaching not using monopersulfuric acid is problematic in that the K value and the remaining HexA amount of the bleached pulp are high as in Comparative Example 3-1 in which the chlorine dioxide addition rate is to give the pulp whiteness on the same level as in Example 4, and therefore the colour reversion resistance of the pulp is poor (the PC value of the pulp is high). In order that the pulp is made to have the colour reversion resistance on the same level as in Example 4, like in Comparative Example 3-2, the chlorine dioxide addition rate must be greatly increased and the whiteness after bleaching becomes too high over the necessary level. In Comparative Example 5 in which the final chlorine dioxide treatment is followed by the monopersulfuric acid treatment, the K value and the remaining HexA amount of the pulp are low and the colour reversion resistance of the pulp has no problem; however, in this, the viscosity reduction is great, and is therefore problematic in that this could not be used in making paper that requires paper strength. In Example 4, monopersulfuric acid is used in combination in the chlorine dioxide treatment stage, and therefore the process does not require any additional bleaching tower as in Comparative Example 5, and its significant advantage is that an existing chlorine dioxide tower can be used in the process.

TABLE 3

| | Whiteness (%) | K value | HexA (μmol/g) | Viscosity (mPa · s) | PC Value |
|---|---|---|---|---|---|
| Example 4 | 87.5 | 1.2 | 7.7 | 16.8 | 2.8 |
| Comparative Example 5 | 87.4 | 1.2 | 7.8 | 12.7 | 2.7 |
| Comparative Example 3-1 | 87.3 | 1.8 | 14.1 | 17.4 | 5.2 |
| Comparative Example 3-2 | 89.3 | 1.2 | 7.5 | 17.1 | 2.8 |

Example 5

A-ZD0/MPS-Eop-D1

60 g of starting unbleached pulp after alkali-oxygen bleaching was sampled in a polyethylene bag. A predetermined amount of water and 1.25% by mass of sulfuric acid were added thereto to control it to have a pH of 3. This was immersed in a thermostat bath, and acid-treated under the above-mentioned predetermined conditions. The treated pulp was washed under the above-mentioned washing condition. 0.5% by mass of ozone was added thereto and this was ozone-treated for 3 minutes. Not washed after the ozone treatment, 0.2% by mass of chlorine dioxide and 0.5% by mass of monopersulfuric acid were added to the pulp in this order, and, under the above-mentioned predetermined conditions, monopersulfuric acid-combined chlorine dioxide treatment is performed in the initial chlorine dioxide treatment stage. The treated pulp was washed under the above-mentioned washing condition. Next, 1.0% by mass of NaOH, 0.15% by mass of oxygen and 0.3% by mass of hydrogen peroxide were added to the pulp, and processed for alkali/oxygen/hydrogen peroxide treatment under the above-mentioned predetermined condition. The treated pulp was washed under the above-mentioned washing condition. Sulfuric acid and 0.1% by mass of chlorine dioxide were added to the washed pulp in this order, mixed, and dipped in a constant temperature water tank for 2 hours. This is the final chlorine dioxide treatment. Sulfuric acid added here was in an amount necessary to make the system have a pH of 5 after the reaction. The treated pulp was washed under the above-mentioned washing condition, and then formed into two pulp sheets in the same manner as in Example 1, and dried in air overnight; and the whiteness, the K value, the HexA amount, the viscosity and the PC value of the pulp were measured.

Comparative Example 6

MPS-ZD0-Eop-D1

This is the same as in Example 5, in which, however, initial monopersulfuric acid treatment of adding 0.5% by mass of monopersulfuric acid was performed in place of the acid treatment before the ozone treatment in Example 5, and monopersulfuric acid was not used in combination in the initial chlorine dioxide treatment stage.

Comparative Example 7-1

A-ZD0-Eop-D1

This is the same as in Example 5, in which, however, the amount of chlorine dioxide added in the initial chlorine dioxide treatment stage was changed from 0.2% by mass in Example 5 to 0.3% by mass, and monopersulfuric acid was not used in combination in the initial chlorine dioxide treatment stage.

Comparative Example 7-2

A-ZD0-Eop-D1

This is the same as in Example 5, in which, however, the amount of chlorine dioxide added in the initial chlorine dioxide treatment stage was changed from 0.2% by mass in Example 5 to 0.5% by mass, and monopersulfuric acid was not used in combination in the initial chlorine dioxide treatment stage.

The results of Example 5, Comparative Examples 6, 7-1 and 7-2 are shown in Table 4.

In Example 5, monopersulfuric acid was used in combination in the initial chlorine dioxide treatment stage after the ozone treatment, and therefore the whiteness, the K value, the HexA amount and the PC value of the bleached pulp were all on a level with no problem, and the pulp viscosity reduction was small. As opposed to this, the case not using monopersulfuric acid is problematic in that the K value and the remaining HexA amount of the bleached pulp are high as in Comparative Example 7-1 in which the chlorine dioxide addition rate is to give the pulp whiteness on the same level as in Example 5, and therefore the colour reversion resistance of the pulp is poor (the PC value of the pulp is high). In order that the pulp is made to have the colour reversion resistance on the same level as in Example 5, like in Comparative Example 7-2, the chlorine dioxide addition rate must be increased. In Comparative Example 6, the K value and the remaining HexA amount of the pulp are low and the colour reversion resistance of the pulp has no problem; however, in this, the viscosity reduction is great, and is therefore problematic in that this could not be used in making paper that requires paper strength. In Example 5, monopersulfuric acid is used in combination in the chlorine dioxide treatment stage, and therefore the process does not require any additional bleaching tower as in Comparative Example 6, and its significant advantage is that an existing chlorine dioxide tower can be used in the process.

TABLE 4

| | Whiteness (%) | K value | HexA (μmol/g) | Viscosity (mPa · s) | PC Value |
|---|---|---|---|---|---|
| Example 5 | 86.3 | 1.1 | 7.5 | 14.8 | 3.2 |
| Comparative Example 6 | 86.4 | 1.1 | 7.4 | 10.7 | 3.1 |
| Comparative Example 7-1 | 85.7 | 1.9 | 14.9 | 15.4 | 5.4 |
| Comparative Example 7-2 | 87.6 | 1.1 | 7.5 | 14.7 | 3.2 |

Example 6

D0/MPS

This is the same as in Example 2, in which, however, in the monopersulfuric acid-combined chlorine dioxide treatment in the initial chlorine dioxide treatment stage in Example 2, chlorine dioxide was added to the pulp and well mixed, and then monopersulfuric acid and sulfuric acid for pH control were added to the pulp in this order.

Example 7

D0/MPS

This is the same as in Example 2, in which, however, in the monopersulfuric acid-combined chlorine dioxide treatment in the initial chlorine dioxide treatment stage in Example 2, monopersulfuric acid was added to the pulp and well mixed, and then sulfuric acid for pH control and chlorine dioxide were added to the pulp in this order.

The results of Examples 2, 6 and 7 are shown in Table 5.

As compared with the process of adding monopersulfuric acid to the alkaline pulp in Example 7, in the processes of Examples 6 and 2 in which monopersulfuric acid is added to the pulp in an acid state, the HexA amount and the K value of the pulp were reduced and the whiteness thereof increased.

This may be because, in Example 7, monopersulfuric acid was added to the pulp that was not as yet in an acid state, and therefore monopersulfuric acid would be decomposed in a higher degree.

TABLE 5

| | Whiteness (%) | K value | HexA (μmol/g) | Viscosity (mPa · s) |
|---|---|---|---|---|
| Example 6 | 72.1 | 2.9 | 17.4 | 16.9 |
| Example 7 | 69.9 | 3.3 | 21.2 | 16.8 |
| Example 2 | 71.3 | 2.5 | 17.3 | 16.9 |

Example 8

D0-Eop-D1/MPS

This is the same as in Example 4, in which, however, in the monopersulfuric acid-combined chlorine dioxide treatment in the final chlorine dioxide treatment stage in Example 4, a sodium hydroxide solution was added to the pulp, well mixed, and then monopersulfuric acid and chlorine dioxide were added to the pulp in this order.

The results of Examples 4 and 8 are shown in Table 6.

As compared with the process of adding monopersulfuric acid to the alkaline pulp in Example 8, in the process of Example 4 in which monopersulfuric acid is added to the pulp in an acid state, the HexA amount and the K value of the pulp were reduced and the whiteness thereof increased.

This may be because, in Example 8, monopersulfuric acid was added to the pulp in an alkaline state, and therefore monopersulfuric acid would be decomposed in a higher degree.

TABLE 6

| | Whiteness (%) | K value | HexA (μmol/g) | Viscosity (mPa · s) | PC Value |
|---|---|---|---|---|---|
| Example 4 | 87.5 | 1.2 | 7.7 | 16.8 | 2.8 |
| Example 8 | 86.6 | 1.5 | 9.6 | 16.8 | 3.9 |

INDUSTRIAL APPLICABILITY

The process for producing bleached pulp of the present invention can improve the colour reversion resistance of chlorine-free bleached pulp with reducing the bleaching cost and keeping the pulp viscosity, for a process which includes subjecting unbleached pulp obtained by cooking a lignocellulose substance to alkali-oxygen bleaching treatment, and then subjecting the alkali-oxygen bleached pulp to chlorine-free bleaching treatment including chlorine dioxide treatment. In particular, the present invention can provide a process for breaching pulp, which is more favorable to the environment, in which the amount of chlorine dioxide to be used can be reduced, and the formation of organic chlorine compound can be retarded.

The invention claimed is:

1. A process for producing bleached pulp, comprising:

subjecting unbleached pulp, which is obtained by cooking a lignocellulose substance, to alkali-oxygen bleaching treatment; and then subjecting the alkali-oxygen bleached pulp to elemental-chlorine-free bleaching treatment including a chlorine dioxide treatment, wherein monopersulfuric acid is added during the chlorine dioxide treatment, and the addition comprises:

adding monopersulfuric acid in an initial stage of the chlorine dioxide treatment after the akali-oxygen bleaching treatment with an addition rate of from 0.1 to 1% by mass, at a treatment pH of from 2.5 to 3.5, a treatment time of from 30 to 120 minutes and a treatment temperature of 60° C. to 80° C.; or adding monopersulfuric acid in a final stage of the chlorine dioxide treatment after the alkali-oxygen bleaching treatment with an addition rate of from 0.1 to 1% by mass, at a treatment pH of from 4.0 to 5.5, a treatment time of from 30 to 120 minutes and a treatment temperature of from 60° C. to 80° C., and wherein the monopersulfuric acid is prepared by mixing sulfuric acid and hydrogen peroxide in a mixing ratio by mole of sulfuric acid to hydrogen peroxide of from 2/1 to 4/1.

2. The process for producing bleached pulp as claimed in claim 1, wherein the elemental-chlorine-free bleaching treatment includes:

the chlorine dioxide treatment in which the monopersulfuric acid is added, then alkali treatment in which oxygen and/or hydrogen peroxide are/is used in combination, and then chlorine dioxide treatment.

3. The process for producing bleached pulp as claimed in claim 1, wherein the elemental-chlorine-free bleaching treatment includes:

chlorine dioxide treatment, then alkali treatment in which oxygen and/or hydrogen peroxide are/is used in combination, and then the chlorine dioxide treatment in which the monopersulfuric acid is added.

4. The process for producing bleached pulp as claimed in claim 1, wherein the elemental-chlorine-free bleaching treatment includes:

ozone bleaching treatment, then with no washing, the chlorine dioxide treatment in which the monopersulfuric acid is added, then alkali treatment in which oxygen and/or hydrogen peroxide are/is used in combination, and then chlorine dioxide treatment.

5. The process for producing bleached pulp as claimed in claim 1, wherein the monopersulfuric acid is added after chlorine dioxide has been added, and the monopersulfuric acid and an acid for pH control are added after chlorine dioxide has been added, or chlorine dioxide and the monopersulfuric acid are added after an acid for pH control has been added.

6. The process for producing bleached pulp as claimed in claim 1, wherein in the chlorine dioxide treatment an alkali is added after chlorine dioxide and monopersulfuric acid have been added, or an alkali is added simultaneously with monopersulfuric acid after chlorine dioxide has been added, for desired pH control.

7. The process for producing bleached pulp as claimed in claim 1, wherein, bleached pulp after the elemental-chlorine-free bleaching treatment has a whiteness of from 70 to 89% and has remaining hexeneuronic acid in an amount of 10 μmol/pulp gram or less.

* * * * *